US008869533B2

(12) United States Patent
Bulat

(10) Patent No.: US 8,869,533 B2
(45) Date of Patent: Oct. 28, 2014

(54) COMBUSTION SYSTEM FOR A GAS TURBINE COMPRISING A RESONATOR

(75) Inventor: Ghenadie Bulat, Lincoln (GB)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/994,791

(22) PCT Filed: Dec. 2, 2011

(86) PCT No.: PCT/EP2011/071595

§ 371 (c)(1),
(2), (4) Date: Jun. 17, 2013

(87) PCT Pub. No.: WO2012/093011

PCT Pub. Date: Jul. 12, 2012

(65) Prior Publication Data

US 2013/0269353 A1 Oct. 17, 2013

(30) Foreign Application Priority Data

Jan. 7, 2011 (EP) ..... 11150379

(51) Int. Cl.
*F02C 7/24* (2006.01)
*F23R 3/16* (2006.01)

(52) U.S. Cl.
CPC ..... *F23R 3/16* (2013.01); *F23M 99/005* (2013.01); *F23R 2900/00014* (2013.01)
USPC ..... 60/725; 60/752

(58) Field of Classification Search
CPC ..... F23M 99/005; F23R 2900/00014; F23R 3/16
USPC ..... 60/39.37, 725, 752, 804
See application file for complete search history.

(56) References Cited

U.S. PATENT DOCUMENTS

| | | | | |
|---|---|---|---|---|
| 5,373,695 | A * | 12/1994 | Aigner et al. | 60/804 |
| 5,428,951 | A * | 7/1995 | Wilson et al. | 60/776 |
| 7,320,222 | B2 | 1/2008 | Flohr | |
| 7,334,408 | B2 * | 2/2008 | Bethke et al. | 60/725 |
| 2007/0000228 | A1 * | 1/2007 | Ohri et al. | 60/39.37 |
| 2010/0011769 | A1 * | 1/2010 | Gambacorta et al. | 60/725 |
| 2010/0293952 | A1 | 11/2010 | Jain | |
| 2011/0179795 | A1 * | 7/2011 | Johnson et al. | 60/725 |
| 2012/0291438 | A1 * | 11/2012 | Bethke | 60/725 |

FOREIGN PATENT DOCUMENTS

| | | | |
|---|---|---|---|
| EP | 0577862 | B1 | 3/1997 |
| EP | 0597138 | B1 | 7/1997 |
| EP | 0974788 | A1 | 1/2000 |

(Continued)

*Primary Examiner* — Phutthiwat Wongwian

(57) ABSTRACT

A combustion system for a gas turbine includes a combustion chamber with a wall section separating an outside of the combustion chamber from an inside of the combustion chamber. The wall section has a passage for injecting a combustion medium into the combustion chamber. The combustion system further includes a resonator with a neck section and a resonator chamber, wherein the neck section and the resonator chamber form a resonator volume reducing vibrations within the combustion chamber. The resonator chamber has a first inlet for injecting gaseous medium into the resonator chamber and a second inlet for injecting fuel into the resonator chamber such that a fuel/gas mixture is generated inside the resonator chamber. The neck section is connected from the outside of the combustion chamber to the passage of the wall section such that the combustion medium comprising the fuel/gas mixture is injectable into the combustion chamber.

16 Claims, 3 Drawing Sheets

(56) References Cited

FOREIGN PATENT DOCUMENTS

| | | | |
|---|---|---|---|
| EP | 1004823 | A2 | 5/2000 |
| EP | 1624250 | A1 | 2/2006 |
| GB | 2462547 | A | 2/2010 |
| WO | WO 0034715 | A1 | 6/2000 |

* cited by examiner

COMBUSTION SYSTEM FOR A GAS TURBINE COMPRISING A RESONATOR

CROSS REFERENCE TO RELATED APPLICATIONS

This application is the US National Stage of International Application No. PCT/EP2011/071595 filed Dec. 2, 2011, and claims benefit thereof, the entire content of which is hereby incorporated by reference. The International Application claims priority to European Application No. 11150379.3 EP filed Jan. 7, 2011, the entire contents of which is hereby incorporated by reference.

FIELD OF INVENTION

The present invention relates to a combustion system for a gas turbine and to a method of manufacturing a combustion system for a gas turbine.

ART BACKGROUND

In today's gas turbines it is an aim to burn the fuel in the combustion chamber in a lean mixture of air and fuel. Such kind of gas turbine combustors may be called dry low emission (DLE) combustion systems, whereby the combustion of the lean fuel mixture produces low NOx (nitrogen oxides) rate and compact flames. However, these systems are prone to combustion dynamics as they run in a lean regime due to the use of the lean mixture of air and fuel. Hence, combustion dynamics may arise as a result of flame excitation, aerodynamic induced excitation or insufficient damping.

The combustion dynamics may cause high acoustic noises wherein it is an aim to reduce those noises, in particular the sound that is generated by the dry low emission combustion systems.

Therefore, in conventional gas turbines, acoustic damping of the critical frequency is performed. Thus, damping devices are installed that are placed directly on the combustion chamber or inside the casings of the gas turbines. The damping devices may be formed of Helmholtz resonator dampers or perforated liners.

Helmholtz resonators are known to be very effective at damping a critical frequency experienced by the gas turbine system. Normally, the Helmholtz resonators are designed to target a critical frequency experienced at a single load point of the gas turbine. When the load of the gas turbine is altered, in particular for example between 50% and 75%, the combustion system might be prone to the combustion dynamics.

In conventional gas turbines, a set of a plurality of Helmholtz resonators with different resonating frequencies are installed that are used to damp different frequencies generated by the combustion dynamics. With this approach, a high number of parts and installation space is required. Moreover, the use of a plurality of Helmholtz resonators might not always be desirable due to geometrical constraints of the gas turbine.

FIG. 4 illustrates a prior art combustion system 400. The combustion system 400 comprises a combustion chamber 401 in which the injected fuel is burnt for generating thermal energy. At an axial end of the tubular-formed combustion chamber 401, the combustion chamber 401 comprises a radial extending pilot face 402. Fuel is injected within the combustion chamber 401 in two or more fuel streams, namely the main fuel stream 405 and the pilot fuel stream 403. The main fuel stream 405 is introduced by a swirler 404, wherein the main fuel stream 405 is introduced in a tubular manner, so that the main fuel is mixed with e.g. air sufficiently until it reaches the flame inside the combustion chamber 401. The pilot fuel stream 403 that is injected inside the combustion chamber 401 from the pilot face 402 streams generally in axial direction in order to guide the main fuel stream 405 in a predetermined direction. The pilot fuel stream 403 has a fuel/air mixture which results in a greater flame stability but with a higher $NO_x$-concentration. The combustion system 400 is generally designed to operate at an optimum between the acceptable levels of combustion dynamics, which comprise generally a key frequency under a predetermined limit, and corresponding $No_x$-emissions.

EP 0 974 788 A1 discloses a device for reducing sound within a streaming machine. A streaming channel connects a Helmholtz resonator volume with a combustion chamber. Within the Helmholtz resonator volume air and water is injected. In the streaming channel between the Helmholtz resonator volume and the combustion fuel is injected. The fuel pipe may comprise an additional Helmholtz resonator volume.

EP 0 577 862 discloses an after-burner for a gas turbine chamber. The air for the combustion in the combustion chamber is guided through a Helmholtz resonator. After passing the Helmholtz resonator, fuel is injected to the combustion air.

EP 1 004 823 A2 discloses a damping device for reducing an amplitude of acoustical waves inside a burner. The combustion air is guided through a Helmholtz resonator. After passing the Helmholtz resonator, pilot fuel is injected to the combustion air.

GB 246 657 A discloses a turbine engine fuel injector with Helmholtz resonator. Inside an annular ring a plurality of fuel injector nozzles are installed, wherein the fuel streams through smaller and larger sized streaming volumes before being injected into a combustion chamber.

EP 0 597 138 B1 discloses a combustion chamber for a gas turbine. Before the combustion air is injected into a pre-chamber of the combustion chamber, the air flows through a Helmholtz resonator. Fuel is separately injected directly to the pre-chamber.

U.S. Pat. No. 7,320,222 B2 discloses a burner for a gas turbine. The volume of a Helmholtz resonator is connected to a fuel pipe. The gas flow streams through the fuel pipe without flowing through the Helmholtz resonator.

SUMMARY OF THE INVENTION

It is an object of the present invention to provide a proper design for a combustion system comprising a noise reduction.

This object may be solved by a combustion system for a gas turbine and by a method for manufacturing a combustion system for a gas turbine according to the independent claims.

According to a first aspect of the present invention, a combustion system for a gas turbine is presented. The combustion system comprises a combustion chamber and a resonator. The combustion chamber comprises a wall section separating an outside of the combustion chamber from an inside of the combustion chamber. The wall section comprises a passage for injecting a combustion medium into the combustion chamber. The resonator comprises a neck section and a resonator chamber, wherein the neck section and the resonator chamber form a resonator volume reducing vibrations within the combustion chamber. The resonator chamber comprises a first inlet for injecting gas into the resonator chamber and a second inlet for injecting fuel into the resonator chamber, such that a fuel/gas mixture is generated inside the resonator chamber. The neck section is connected from the outside of the combustion chamber to the passage of the wall section, such that the combustion medium comprising the fuel/gas mixture is injectable into the combustion chamber.

According to a further aspect of the present invention, a method of manufacturing a combustion system for a gas turbine is presented. According to the method, a combustion chamber with the wall section separating an outside of the combustion chamber from an inside of the combustion chamber is formed. The wall section comprises a passage for injecting a combustion medium into the combustion chamber. Next, a resonator with a neck section and a resonator chamber is formed, wherein the neck section and the resonator chamber form a resonator volume reducing vibrations within the combustion chamber. Furthermore, a first inlet for injecting gas into the resonator chamber and a second inlet for injecting fuel into the resonator chamber are formed, such that a fuel/gas mixture is generated inside the resonator chamber. Next, the neck section is connected from the outside of the combustion chamber to the passage of the wall section, such that the combustion medium comprising the fuel/gas mixture is injectable into the inside of the combustion chamber.

The combustion chamber is generally formed in a tubular-like shape. The combustion chamber may comprise a pre-chamber with a smaller diameter and a main chamber with a larger diameter than the pre-chamber. The pre-chamber is defined by a shell surface extending generally in an axial direction and by the wall section that runs in general in radial direction with respect to a center axis of the combustion chamber.

In the wall section the passage is formed, through which the combustion mediums is injectable inside the combustion chamber, e.g. the pre-chamber. In particular, the injected combustion medium forms the pilot fuel stream, which is adapted for controlling the flow direction of the main fuel stream. The main fuel stream is generally injected, e.g. by a swirler which is attached to the shell surface of the combustion chamber, e.g. the pre-chamber.

To the passage, a tube connection or any other connection to the neck section of the resonator is formed. Hence, the fuel and the gas that is injected by the first and second inlet into the resonator are injectable through the passage into the combustion chamber, in particular into the pre-chamber.

Particularly, the gas and the fuel are injected by first and second inlets into the resonator chamber of the resonator. The resonator chamber comprises a larger diameter and a larger volume than the diameter and the volume of the neck section. Hence, inside the larger resonator chamber, a proper mixing of the gas and the fuel is achieved, such that a homogenous fuel/gas mixture to be injected through the passage into the combustion chamber is achieved.

Moreover, the neck section and the resonator chamber of the resonator form the resonator volume with which vibrations, such as sound, within the combustion chamber, are reducible.

The resonator, e.g. a Helmholtz resonator, has a predefined resonance frequency. When the resonator frequency is adapted to a key frequency of the vibrations of the oscillating gas stream of the gas turbine, the resonator may reduce the peaks of the vibration, e.g. of the acoustical waves, produced by the gas stream.

The frequency, in particular the resonant frequency, of the resonator is dependent on geometrical constraints of the resonator, as is shown in the following formula:

$$\text{Frequency: } f = \frac{c}{2\pi}\sqrt{\frac{S}{l \cdot V}}$$

wherein

S is the cross-sectional area of the neck section of the resonator (wherein S may e.g. be calculated for circle cross-section with $\pi r^2$), V is the resonator's volume, l is the effective length of the resonator's neck section which is based on the geometric neck length, and c is the speed of sound.

Taking into account the above-described formula, by amending the geometrical constraints S, l and V, and/or by amending the speed of sound c, the frequency of the resonator may be adjusted to the frequency of the vibrations generated by the gas stream of the turbine. The speed of sound is for example amendable by amending the temperature of the fuel/gas mixture in the resonator.

In particular, the first inlet and the second inlet are formed in a face of the resonator chamber. Through the inlets the fuel and the gaseous medium may be injected in a controlled manner, such that the amount, the speed and the streaming properties (turbulent, linear) are adjustable for the injected gaseous medium and/or the fuel.

Hence, by the present invention, by placing and connecting the resonator directly to the wall section (i.e. to the pilot face) of the combustion chamber and by mixing the fuel and the gas inside the resonator chamber, a proper and homogenous fuel/gas mixture is achieved for being injected into the combustion chamber. Additionally, the injection speed of the fuel and the gas inside the resonator chamber may affect the speed of sound c, so that the resonator frequency may be controlled. Moreover, separate mixing devices or separated vibration reduce system may be obsolete.

By the combustion system of the present invention, the resonator fulfills both function, namely the mixing function for mixing gas and fuel and the vibration reduction function for reducing vibrations within the combustion chamber. In previous approaches, the fuel is directly injected in the combustion chamber or in the passage or neck section of a feeding pipe. By the present invention, the fuel and the gas is injected directly in the resonator chamber of the resonator. Hence, the large volume of the resonator chamber is used for providing space from mixing both components to a homogenous fuel/gas mixture. Additionally, the injection of the gas and the fuel may define the resonator frequency such that a reduction of the vibrations is achieved. Hence, a proper and efficient design of the combustion system including a vibration reducing function is achieved.

By the term "gaseous medium" a medium comprising air, steam, hydrocarbon, hydrogen, carbon e.g. carbon dioxide and/or an oxidant may be denoted.

By the term "fuel" a gaseous or liquid medium may be denoted. For example, fuel may comprise natural gas, biogas, hydrogen or any other combustible gas. Moreover, fuel may comprise diesel, benzene, kerosene or any other combustible liquid medium.

The fuel/gas mixture may denote a mixture of different gases or a mixture of a gaseous medium comprising solid fuel particles, for example.

According to a further exemplary embodiment, the wall section and the resonator are formed monolithically, such that the resonator is integrated into the wall section. Hence, if the wall section comprises for example a homogeneous body, the resonator may be formed by milling or drilling the neck section and the resonator chamber in the material of the wall section. Moreover, the wall section may be formed monolithically with the resonator chamber and the resonator neck in a casting process.

The neck section may be formed by the passages itself, wherein the passage may form through-holes between the inner volume of the combustion chamber and the volume of the resonator chamber. Hence, according to a further exemplary embodiment, the neck section is integrated in the wall section, such that the passage is formed by the neck section. By the above described monolithical and integral embodiments a proper and efficient design for the combustion chamber may be achieved. Further separated parts that are additionally fixed to the combustion chamber for achieving a fluid mixture or a noise reduction are obsolete, such that a robust combustion system with a lower error-proneness is achieved.

According to a further exemplary embodiment, the first inlet and/or the second inlet comprise(s) a nozzle. The nozzle may be formed by a conical shape of the first inlet and the second inlet. Hence, by providing nozzles, a turbulent injection of the fuel and the gas may be achieved which results in a proper mixture, i.e. in a more homogenous fuel/gas mixture.

According to a further exemplary embodiment, the resonator chamber further comprises a further inlet for injecting a further liquid medium or a further gaseous medium into the resonator chamber. Hence, by providing a further inlet or a plurality of further inlets, a variety of different components of the fuel/gas mixture may be injected, such that a complex and homogenous fuel/gas mixture is generatable, wherein the fuel/gas mixture is adaptable to predetermined combustion characteristics. The further liquid medium may be for example a medium that acts as a catalyser or a medium that acts as a pollutant reduction medium. The further liquid medium or the further gaseous medium may be for example water.

According to a further exemplary embodiment, the wall section comprises a further passage for injecting the combustion medium through the further passage into the combustion chamber. The resonator further comprises a further neck section, such that the resonator volume is formed by the neck section, the further neck section and the resonator chamber. The further neck section is connected from the outside of the combustion chamber to the further passage and of the wall section, such that the combustion medium comprising the fuel/gas mixture is injectable into the inside of the combustion chamber. Hence, instead of providing one large neck section, a plurality of sub-neck sections with respective smaller diameters with respect to the embodiment comprising only one neck section, is formed. Hence, an improved injection characteristic of the gas/fuel mixture into the combustion medium may be achieved. Additionally, the further neck section and the neck section may as well be formed monolithically in the wall section, such that the passage and the further passage are formed by a neck section and a further neck section.

According to a further exemplary embodiment, the combustion chamber comprises a first sub-chamber and a second sub-chamber or a plurality of sub-chambers. The first sub-chamber is connected to the neck section and the second sub-chamber is connected to the further neck section. Hence, a first resonator volume may be formed by the first sub-chamber and the first neck section and the second resonator volume may be formed by the second sub-chamber and the second neck section. Hence, two different resonator volumes may be formed within one and the same resonator. Each of the resonator volumes may define different resonator frequency, such that one and the same resonator has more than one resonator frequencies for reducing different vibration, each comprising a different key frequency. By adjusting each of the resonator volumes separately, desired vibrations with predetermined key frequencies may be reduced. Each first sub-chamber and second sub-chamber comprises respective first inlets and second inlets, such that into each first sub-chamber and second sub-chamber gaseous medium and fluid is injectable individually. Hence, the gaseous medium and the fluid in the first sub-chamber is injected with a first injection speed and volume flow whereas the gaseous medium and the fluid in the second sub-chamber is injected with a second injection speed and volume flow. Hence, beside the respective volume measures, the respective resonator frequencies in the first and second sub-chamber may be adjusted as well by the respective injection characteristics of the gaseous medium and the fluid into the respective first and second sub-chambers.

According to a further exemplary embodiment, the resonator further comprises a deformable element installed the resonator volume. The deformable element is formed such that the shape of the deformable element is amendable for adjusting the resonator frequency. In particular, according to a further exemplary embodiment, the deformable element is formed for being deformable under an influence of a change of a gas turbine temperature. A shape of the deformable element is predetermined with respect to a respective gas turbine temperature. A deformable element is thermally coupled to the combustion chamber in such a way that the shape of the deformable element depends on the respective gas turbine temperature.

According to a further exemplary embodiment, the combustion system further comprises a swirler. The combustion chamber comprises a further wall section that forms in particular the shell area of the combustion chamber. In particular, the further wall section is non-parallel to the wall section. The swirler is mounted to the further wall section in such a way that a combustion fluid, such as the main fuel, is injectable to the further wall section inside the combustion chamber in a turbulent manner.

By the present invention, a combustion system for a gas turbine comprising a resonator with an improved design is achieved. The above described design of the combustion system has a placement advantage and simultaneously targets a key frequency of the combustion system whilst providing a proper pre-mix fluid/gas mixture. Hence, additionally the flame stability is improved, such that the diffusion pilot fuel stream may be replaceable. The above described resonator in the combustion system is installed in a vicinity of the combustion chamber (e.g. a radial burner), wherein the resonator is connected to the wall element (burner's pilot face) through a single or a plurality of passages, wherein the passages may form the neck sections of the resonator. Hence, additional space for attaching a separate resonator, e.g. to a wall of the combustion chamber is not needed. Moreover, because the gaseous medium and the fuel are injected inside the Helmholtz resonator, the Helmholtz resonator is cooled by the gas and the fuel, such that additional cooling devices may be obsolete. Moreover, because an improved mix of the fuel and the gaseous medium inside the resonator chamber, a more homogenous combustion medium is injected into the combustion chamber, so that a better mixing and thus a lower $NO_x$-concentration and an improved flame stability is achievable.

Moreover, when attaching the resonator directly to the wall surface (pilot face), the vibration generated by burning the combustion medium, may be reduced more efficiently, because the resonator may be installed closer to the flame than in previous approaches. Because the pre-mixed combustion medium is injected by the resonator, a further diffusion pilot stream installed to the wall surface may be obsolete.

Particularly pilot fuel may not be injected directly into the combustion chamber. Pilot fuel may only be injected into the resonator chamber. Possibly also a mix of different pilot fuel inlets can be implemented. Some pilot fuel streams may be injected directly into the combustion chamber, some other pilot fuel streams may be injected into the resonator chamber.

Moreover, by the present invention a simple design of a combustion system including a resonator is achieved. Hence, the resonator acting as a vibration damper may be attached as well to conventional combustion chambers such that a quick field retrofit is possible.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

BRIEF DESCRIPTION OF THE DRAWINGS

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1:
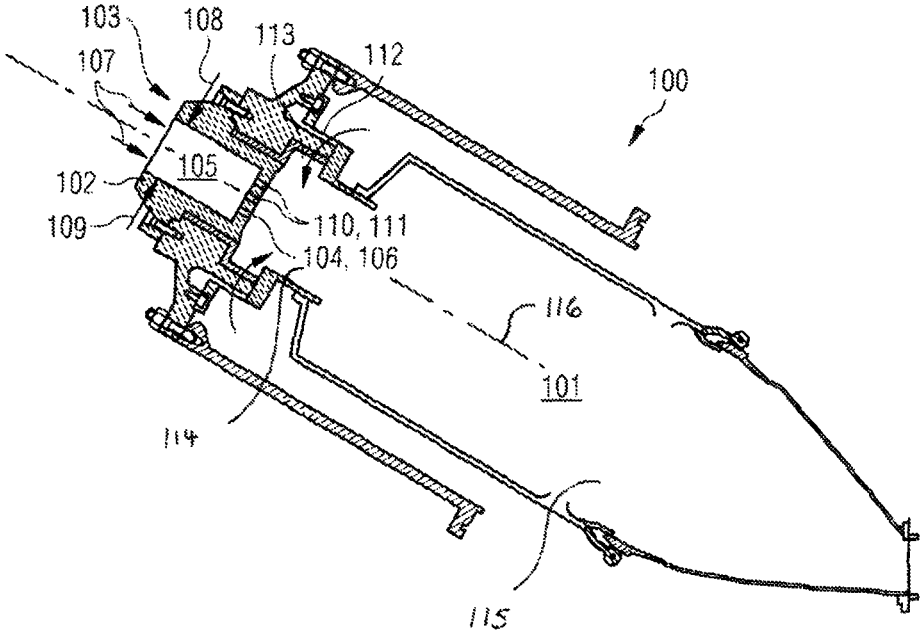
FIG. 1 shows a combustion system according to an exemplary embodiment of the present invention.

The illustrations in the drawings are schematical. It is noted that in different figures, similar or identical elements are provided with the same reference signs.

FIG. 1 shows a combustion system 100 for a gas turbine. The combustion system 100 comprises a combustion chamber 101 with a wall section 102 separating an outside of the combustion chamber 101 from an inside of the combustion chamber 101. The wall section 102 comprises a passage 106 for injecting a combustion medium into the combustion chamber 101. Moreover, the combustion system 100 comprises a resonator 103 with a neck section 104 and a resonator chamber 105. The neck section 104 and the resonator chamber 105 form a resonator volume reducing vibrations within the combustion chamber 101. The resonator chamber 105 comprises a first inlet 107 for injecting the gaseous medium into the resonator chamber 105 and a second inlet 108 for injecting fuel into the resonator chamber 105, such that a fuel/gas mixture is generated inside the resonator chamber 105. The neck section 104 is connected from the outside of the combustion chamber 101 to the passage 106 of the wall section 102, such that the combustion medium comprising the fuel/gas mixture is injectable into the combustion chamber 101.

As can be seen in FIG. 1, the combustion chamber 101 comprises a main chamber with a larger diameter than a pre-chamber. The wall section 102 forms a section of the pre-chamber of the combustion chamber 101. The wall section 102 comprises the passage 106 and the further passage 111 through which the combustion medium is injectable.

In the exemplary embodiment of FIG. 1, the wall section 102 comprises a body into which the resonator 103 is formed. Hence, the wall section 102 and the resonator 103 are monolithically formed. Inside the body of the wall section, the resonator chamber 105 is formed. The neck section 104 and the further neck section 110 are formed by the passages 106, 111. To the first inlet 107 and the second inlet 108 the gaseous medium and/or the fuel—as pilot fuel—is injectable inside the resonator chamber 105 such that a proper and homogenous mixture of the combustion medium is achieved.

Additionally, through a further inlet 109 a further gaseous or liquid medium is injectable into the resonator chamber 105.

Moreover, a swirler 112 may be formed within further wall sections 113. Through the swirler 113 a main fuel stream may be injectable inside the pre-chamber of the combustion chamber 101.

Figure 2:
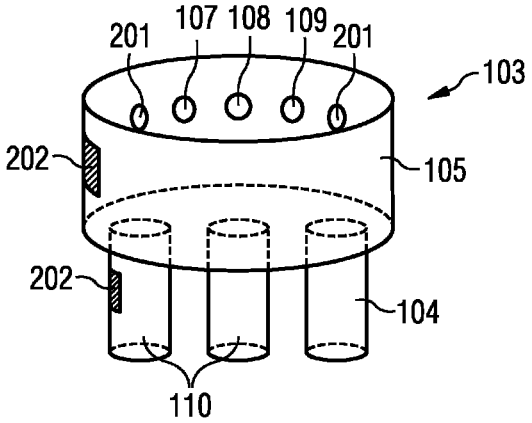
FIG. 2 illustrates a resonator comprising a plurality of inlets and neck sections according to an exemplary embodiment of the present invention.

FIG. 2 illustrates a more detailed view of the resonator 103. At a first face, a plurality of inlets, namely the first inlet 107, the second inlet 108 and the further inlet 109 is shown. Through the inlets 107, 108, 109 a respective fuel or gaseous medium—particularly pilot fuel—is injectable inside the resonator chamber 105. In another face of the resonator 103, the neck section 104 and the further neck sections 110 are installed through which the combustion medium inside the resonator chamber 106 may be exhausted into the combustion chamber 101.

In order to amend the resonator volume and the dimensions of the resonator chamber 105 and/or the neck sections 104, 110, deformable elements 202 are installed. The deformable elements 202 may amend its sizes or shapes in order to adjust the resonator frequency. The deformable element 202 may be a piston that is controlled mechanically in order to adjust a frequency. Moreover, the deformable element 202 may as well be a bi-metallic component, such that according to a predetermined temperature, a predetermined shape of the deformable element 202 is adjustable.

Moreover, besides the inlets 107, 108, 109, purge connections 201 are shown that provide a connection between the volume of the resonator 103 and the environment, such that undesired pressure conditions inside the resonator 103 may be prevented.

Figure 3:
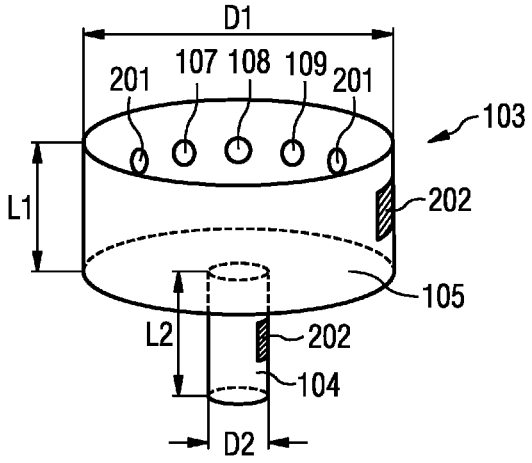
FIG. 3 shows a resonator comprising one neck section according to an exemplary embodiment of the present invention.
Figure 4:
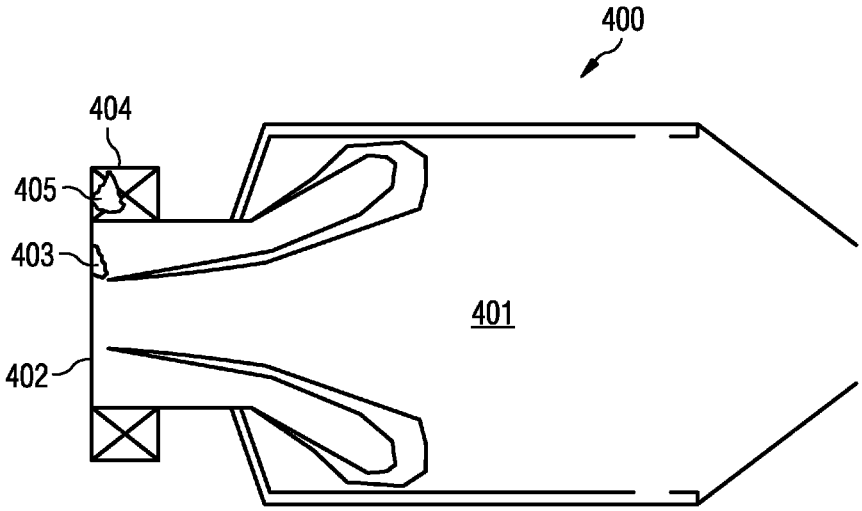
FIG 4 PRIOR ART
FIG. 4 shows a conventional combustion system.

FIG. 3 illustrates a further view of a resonator 103 according to an exemplary embodiment. As shown in FIG. 3, the resonator chamber 105 comprises the several inlets 107, 108, 109 and the purge connection 201. Moreover, to the neck section 104 and to the resonator volume 105 the deformable elements 202 are installed. As shown in FIG. 3, the resonator chamber 105 is defined by its length L1 and its diameter D1. The dimensions of the neck section 104 are defined by its diameter D2 and its length L2.

The resonator chamber 105 of the resonator 103 provides a larger volume than the neck section 104. The neck section 104 provides a tight opening for connecting the resonator chamber 105 to the combustion chamber 101. The fuel/gas mixture in the volume of the resonator chamber 105 provides an elasticity, wherein the fuel/gas mixture inside the neck section 104 provides an inertia mass of the gas. Thus, the frequency F may be defined by the formula:

$$F + \sqrt{\frac{\text{elasticity}}{inertialmass}}$$

In particular, the frequency of such a resonator is defined by:

$$F = \frac{c}{2\pi}\sqrt{\frac{S}{l}\cdot V}$$

wherein the speed of sound c is dependent on the temperature T:

$$c = \sqrt{\frac{\kappa \cdot R \cdot T}{M}}$$

Thus, for different operating loads of the gas turbine and thus due to the different fuel/gas mixture stream temperatures T, the frequency F of the resonator differs and may be adjusted.

In an exemplary embodiment of the combustion system, the resonator chamber 105 may have a diameter $D_1$ of approximately 0.05 m to approximately 0.07 m (meters), preferably 0.06 m. The diameter $D_2$ of the neck section 104 may be approximately 0.0005 to approximately 0.002 m, preferably 0.001 m. The length $L_1$ of resonator chamber 105 may be approximately 0.070 m to approximately 0.090 m, preferably 0.080 m. The length $L_2$ of the neck section 104 may be approximately 0.0050 m to approximately 0.0060 m, preferably 0.0055 m.

If the wall section 102 and the resonator 103 are formed monolithically such that the resonator 103 is integrated into the wall section 102, the wall section 102 may have a respective width that corresponds to the sum of the length $L_1$ of resonator chamber 105 and the length $L_2$ of the neck section 104. The resonator chamber 105 and the at least one neck section 104 may be drilled with their respective diameters $D_1$, $D_2$ into the wall section 102.

A resonator 103 according to the present invention may comprise more than one neck section 104. For example, the resonator 103 may comprise eight neck sections 104.

For example, the gas temperature in the resonator 103 may be approximately 500 K to approximately 600 K (Kelvin), preferably 523 K, such that the resonator 103 may have a resonator frequency of approximately 100 Hz to approximately 200 Hz, preferably approximately 164 Hz.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

The invention claimed is:

1. Combustion system for a gas turbine, the combustion system comprising:

a combustion chamber having a pilot injector and a main injector, the pilot injector having a wall section separating an outside of the combustion chamber from an inside of the combustion chamber, wherein the wall section comprises a passage for injecting a combustion medium into the combustion chamber, and a resonator with a neck section and a resonator chamber, wherein the neck section and the resonator chamber form a resonator volume reducing vibrations within the combustion chamber, the main injector having a radial swirler arranged such that fuel/gas is injectable into the combustion chamber, wherein the resonator chamber comprises a first inlet for injecting gaseous medium into the resonator chamber and a second inlet for injecting fuel into the resonator chamber such that a fuel/gas mixture is generated inside the resonator chamber, and wherein the neck section is connected from the outside of the combustion chamber to the passage of the wall section such that the combustion medium comprising the fuel/gas mixture is injectable into the combustion chamber.

2. Combustion system according to claim 1, wherein the wall section and the resonator are formed monolithically such that the resonator is integrated into the wall section.

3. Combustion system according to claim 1, wherein the first inlet and/or the second inlet comprise(s) a nozzle.

4. Combustion system according to claim 1, wherein the gaseous medium is selected from the group consisting of air, hydrocarbon, hydrogen, an oxidant and a combination thereof.

5. Combustion system according to claim 1, wherein the resonator chamber further comprises a further inlet for injecting a further liquid medium or a further gaseous medium into the resonator chamber.

6. Combustion system according to claim 1, wherein the neck section is integrated in the wall section such that the passage is formed by the neck section.

7. Combustion system according to claim 1, wherein the wall section comprises a further passage for injecting the combustion medium through the further passage into the combustion chamber, wherein the resonator further comprises a further neck section such that the resonator volume is formed by the neck section, the further neck section and the resonator chamber, and wherein the further neck section is connected from the outside of the combustion chamber to the further passage of the wall section such that the combustion medium comprising the fuel/gas mixture is injectable into the inside of the combustion chamber.

8. Combustion system according to claim 7, wherein the combustion chamber comprises a first sub-chamber and a second sub-chamber, and wherein the first sub-chamber is connected to the neck-section and the second sub chamber is connected to the further neck section.

9. Combustion system according to claim 1, wherein the resonator further comprises a deformable element installed inside the resonator volume, and wherein deformable element is formed such that the shape of the deformable element is amendable for adjusting the resonator frequency.

10. Combustion system according to claim 9, wherein the deformable element is formed for being deformable under an influence of a change of a gas turbine temperature, wherein a shape of the deformable element is predetermined with respect to a respective gas turbine temperature, and wherein the deformable element is thermally coupled to the combustion chamber in such a way that the shape of the deformable element depends on the respective gas turbine temperature.

11. Combustion system according to claim 1, further comprising:

a swirler, wherein the combustion chamber comprises a further wall section, and wherein the swirler is mounted to the further wall section such that a combustion fluid is injectable through the further wall section inside the combustion chamber in a turbulent manner.

12. Combustion system for a gas turbine, as claimed in claim 1 wherein the combustion chamber comprises a pre-chamber and a main chamber, the swirler is arranged such that fuel/gas is injectable into the pre-chamber, and the neck section is arranged such that the fuel/gas mixture is injectable into the pre-chamber.

13. Combustion system for a gas turbine as claimed in claim 1, wherein the pilot injector is located upstream of the main injector.

14. Combustion system for a gas turbine as claimed in claim 1, wherein the neck section is located upstream of the swirler.

15. Combustion system for a gas turbine as claimed in claim 1, wherein the combustion chamber has a central axis and in axial series is the pilot injector, the main injector, the pre-chamber and the main chamber.

16. Method of manufacturing a combustion system for a gas turbine, the method comprising:

forming a combustion chamber having a pilot injector and a main injector, the pilot injector having a wall section separating an outside of the combustion chamber from an inside of the combustion chamber, wherein the wall section comprises a passage for injecting a combustion medium into the combustion chamber, forming a resonator with a neck section and a resonator chamber, wherein the neck section and the resonator chamber form a resonator volume reducing vibrations within the combustion chamber, the main injector having a radial swirler arranged such that fuel/gas is injectable into the combustion chamber forming a first inlet for injecting gaseous medium into the resonator chamber and a second inlet for injecting fuel into the resonator chamber such that a fuel/gas mixture is generated inside the resonator chamber, and connecting the neck section from the outside of the combustion chamber to the passage of the wall section such that the combustion medium comprising the fuel/gas mixture is injectable into the inside of the combustion chamber.

* * * * *